US007992956B2

(12) United States Patent
Shang et al.

(10) Patent No.: US 7,992,956 B2
(45) Date of Patent: Aug. 9, 2011

(54) SYSTEMS AND METHODS FOR CALIBRATING INKJET PRINT HEAD NOZZLES USING LIGHT TRANSMITTANCE MEASURED THROUGH DEPOSITED INK

(75) Inventors: Quanyuan Shang, Saratoga, CA (US); John M. White, Hayward, CA (US)

(73) Assignee: Applied Materials, Inc., Santa Clara, CA (US)

( * ) Notice: Subject to any disclaimer, the term of this patent is extended or adjusted under 35 U.S.C. 154(b) by 560 days.

(21) Appl. No.: 11/758,631

(22) Filed: Jun. 5, 2007

(65) Prior Publication Data

US 2007/0285454 A1 Dec. 13, 2007

Related U.S. Application Data

(60) Provisional application No. 60/804,166, filed on Jun. 7, 2006.

(51) Int. Cl.
*B41J 29/393* (2006.01)

(52) U.S. Cl. ..... 347/19; 347/5; 347/14

(58) Field of Classification Search ..... 347/19, 347/5, 9, 3–4, 14, 15; 427/77
See application file for complete search history.

(56) References Cited

U.S. PATENT DOCUMENTS

| | | | | |
|---|---|---|---|---|
| 5,593,757 | A | 1/1997 | Kashiwazaki et al. | |
| 5,811,209 | A | 9/1998 | Eida et al. | |
| 5,895,692 | A | 4/1999 | Shirasaki et al. | |
| 5,948,576 | A | 9/1999 | Shirota et al. | |
| 5,956,063 | A | 9/1999 | Yokoi et al. | |
| 5,984,470 | A | 11/1999 | Sakino et al. | |
| 5,989,757 | A | 11/1999 | Satoi | |
| 6,025,898 | A | 2/2000 | Kashiwazaki et al. | |
| 6,036,298 | A * | 3/2000 | Walker | 347/19 |
| 6,066,357 | A | 5/2000 | Tang et al. | |
| 6,134,059 | A | 10/2000 | Shirota et al. | |
| 6,142,604 | A | 11/2000 | Kanda et al. | |
| 6,224,205 | B1 | 5/2001 | Akahira et al. | |
| 6,228,435 | B1 | 5/2001 | Yoshikawa et al. | |

(Continued)

FOREIGN PATENT DOCUMENTS

EP 0 675 385 A1 10/1995

(Continued)

OTHER PUBLICATIONS

Office Action of Korean Applicantion No. 2007-54938 (11129/SK) dated Feb. 5, 2008.

(Continued)

*Primary Examiner* — Lam S Nguyen
(74) *Attorney, Agent, or Firm* — Dugan & Dugan, PC

(57) ABSTRACT

The present invention provides inkjet print nozzle calibration systems and methods for calibrating an inkjet print nozzle. The systems may include an inkjet print nozzle adapted to dispense ink onto a substrate in response to a firing pulse voltage, a light source adapted to illuminate the dispensed ink, an imaging system adapted to measure a transmittance of light through the dispensed ink, and a controller adapted to controllably adjust the inkjet print nozzle based on the measured light transmittance. The methods may include dispensing ink onto a surface with an inkjet print nozzle set at a firing pulse voltage, measuring a light transmittance characteristic of the dispensed ink, determining a volume of ink dispensed based on the transmittance characteristic, and adjusting a fire pulse voltage of the inkjet print nozzle based on a difference between the determined volume of ink dispensed and an expected volume level of ink dispensed.

19 Claims, 5 Drawing Sheets

U.S. PATENT DOCUMENTS

| | | | | |
|---|---|---|---|---|
| 6,242,139 | B1 | 6/2001 | Hedrick et al. | |
| 6,270,930 | B1 | 8/2001 | Okabe et al. | |
| 6,277,529 | B1 | 8/2001 | Marumoto et al. | |
| 6,341,840 | B1 | 1/2002 | van Doorn et al. | |
| 6,367,908 | B1 | 4/2002 | Serra et al. | |
| 6,464,329 | B1 | 10/2002 | Koitabashi et al. | |
| 6,464,331 | B1 | 10/2002 | Van Doorn et al. | |
| 6,667,795 | B2 | 12/2003 | Shigemura | |
| 6,698,866 | B2 | 3/2004 | Ward et al. | |
| 7,185,966 | B2 | 3/2007 | Kamiyama et al. | |
| 2002/0054197 | A1 | 5/2002 | Okada et al. | |
| 2002/0089561 | A1* | 7/2002 | Weitzel et al. | 347/19 |
| 2003/0030715 | A1 | 2/2003 | Cheng et al. | |
| 2003/0103095 | A1* | 6/2003 | Imai | 347/5 |
| 2003/0117455 | A1 | 6/2003 | Bruch et al. | |
| 2003/0118921 | A1 | 6/2003 | Chen et al. | |
| 2003/0189604 | A1 | 10/2003 | Bae et al. | |
| 2003/0218645 | A1 | 11/2003 | Dings et al. | |
| 2004/0023567 | A1 | 2/2004 | Koyama et al. | |
| 2004/0109038 | A1* | 6/2004 | Newsome et al. | 347/19 |
| 2004/0146637 | A1* | 7/2004 | Banno et al. | 427/77 |
| 2006/0071957 | A1 | 4/2006 | Shang et al. | |
| 2006/0092219 | A1 | 5/2006 | Kurita et al. | |
| 2007/0065571 | A1 | 3/2007 | White et al. | |
| 2007/0070105 | A1 | 3/2007 | Sun et al. | |

FOREIGN PATENT DOCUMENTS

| | | | |
|---|---|---|---|
| EP | 1 106 360 | A1 | 6/2001 |
| JP | 59-075205 | | 4/1984 |
| JP | 63-235901 | | 9/1988 |
| JP | 63-294503 | | 12/1988 |
| JP | 02-173703 | | 7/1990 |
| JP | 02-173704 | | 7/1990 |
| JP | 8-309969 | | 11/1996 |
| JP | 10-073813 | | 3/1998 |
| TW | 1225828 | | 1/2005 |
| WO | WO 02/14076 | A1 | 2/2002 |

OTHER PUBLICATIONS

U.S. Appl. No. 12/329,585, filed Dec. 6, 2008.

U.S. Appl. No. 12/329,587, filed Dec. 6, 2008.

U.S. Appl. No. 12/413,111, filed Mar. 27, 2009.

Office Action Chinese Application No. 2007101110463.3 dated Jun. 26, 2009.

Search Report of Taiwan Application No. 096120192 Dated Sep. 16, 2009.

* cited by examiner

SYSTEMS AND METHODS FOR CALIBRATING INKJET PRINT HEAD NOZZLES USING LIGHT TRANSMITTANCE MEASURED THROUGH DEPOSITED INK

The present application claims priority to U.S. Provisional Patent Application Ser. No. 60/804,166, filed Jun. 7, 2006 and entitled "SYSTEMS AND METHODS FOR CALIBRATING INKJET PRINT HEAD NOZZLES USING LIGHT TRANSMITTANCE MEASURED THROUGH DEPOSITED INK", which is hereby incorporated by reference herein in its entirety for all purposes.

CROSS-REFERENCE TO RELATED APPLICATIONS

The present application is related to the following commonly-assigned, co-pending U.S. patent applications, each of which is hereby incorporated herein by reference in its entirety for all purposes:

U.S. Provisional Patent Application Ser. No. 60/785,594 filed Mar. 24, 2006 and entitled "METHODS AND APPARATUS FOR INK JET PRINTING";

U.S. patent application Ser. No. 11/123,502 filed May 4, 2005 and entitled "DROPLET VISUALIZATION OF INKJETTING";

U.S. patent application Ser. No. 11/212,043 filed Aug. 25, 2005 and entitled "METHODS AND APPARATUS FOR ALIGNING INKJET PRINT HEAD SUPPORTS";

U.S. patent application Ser. No. 11/521,177 filed Sep. 13, 2006 and entitled "METHOD AND APPARATUS FOR MANUFACTURING A PIXEL MATRIX OF A COLOR FILTER FOR A FLAT PANEL DISPLAY"; and U.S. patent application Ser. No. 11/536,540 filed Sep. 28, 2006 and entitled "METHODS AND APPARATUS FOR ADJUSTING PIXEL PROFILES".

BACKGROUND

The flat panel display industry has been attempting to employ inkjet printing to manufacture display devices, and in particular, color filters for flat panel displays. Because the pixel wells into which ink is dispensed when printing patterns for color filters may be particularly small, the possibility of printing error is significant. In addition, manufacturing variations in print heads may result in undesirable printing performance or irregularities. Therefore, efficient methods and apparatus for calibrating inkjet print heads and making adjustments to printing parameters are desirable.

SUMMARY OF THE INVENTION

In aspects of the present invention, embodiments of an inkjet print nozzle calibration system include an inkjet print nozzle adapted to dispense ink onto a substrate in response to a firing pulse parameter (e.g., a firing pulse voltage, a firing pulse width, a firing pulse current, a firing pulse energy, a firing pulse frequency, a firing pulse waveform shape, etc.), a light source adapted to illuminate ink dispensed on the substrate, an imaging system adapted to measure a transmittance of light through the dispensed ink; and a controller coupled to the imaging system and the inkjet print nozzle and adapted to controllably adjust the one or more inkjet print nozzles based on the measured light transmittance.

In other aspects of the present invention, embodiments of methods of calibrating an inkjet print nozzle include dispensing ink onto a substrate with an inkjet print nozzle, the nozzle set at a firing pulse parameter (e.g., a firing pulse voltage, a firing pulse width, a firing pulse current, a firing pulse energy, a firing pulse frequency, a firing pulse waveform shape, etc.), measuring a light transmittance characteristic of the dispensed ink, determining a volume of ink dispensed based on the measured transmittance characteristic, and adjusting a fire pulse voltage of the inkjet print nozzle based on a difference between the determined volume of ink dispensed and an expected ink volume level.

Other features and aspects of the present invention will become more fully apparent from the following detailed description, the appended claims, and the accompanying drawings.

DETAILED DESCRIPTION

Figure 1A:
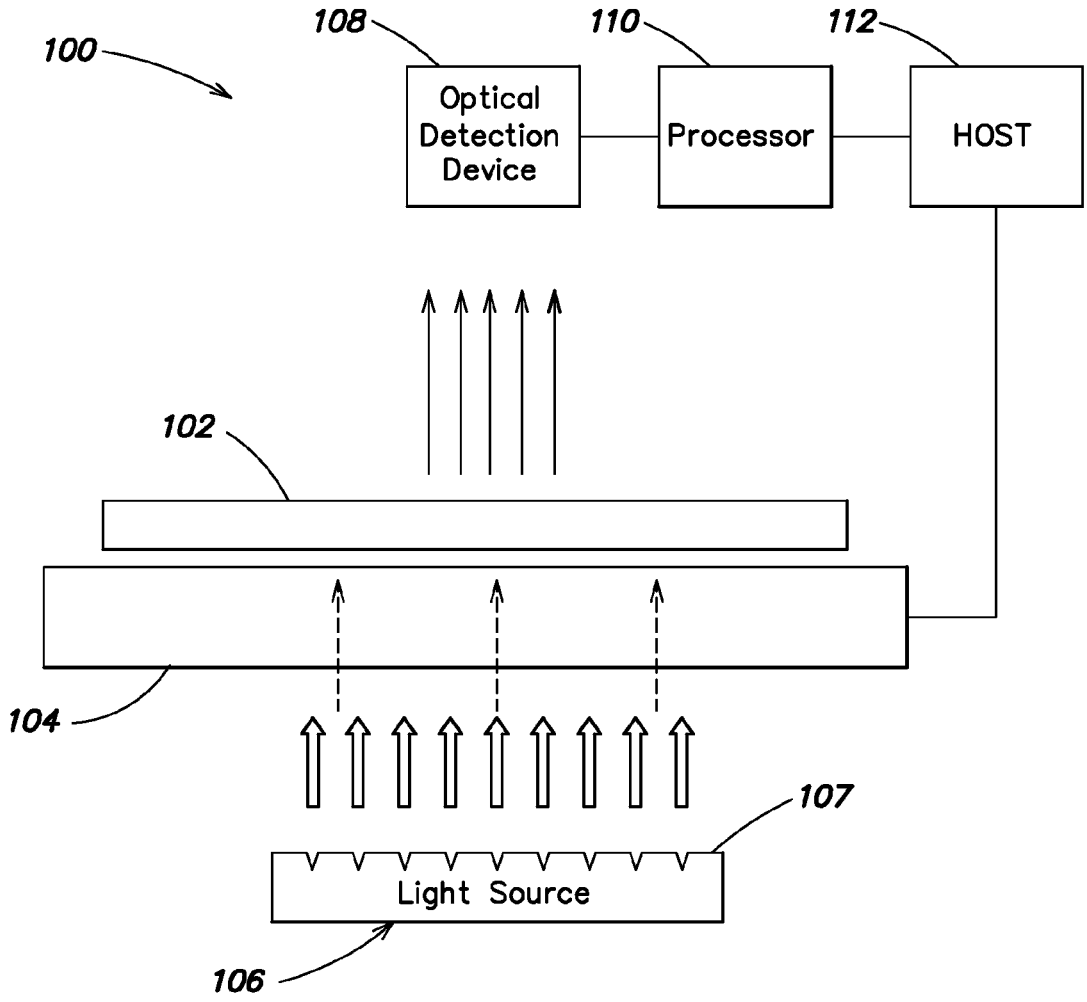
FIG. 1A is a schematic diagram of an inkjet print nozzle calibration system in accordance with embodiments of the present invention.

Inkjet printers frequently make use of one or more inkjet print heads mounted within one or more carriages that may be moved above a substrate, such as a glass or polymer panel, to print a color filter for a flat panel display. In some embodiments, the substrate is moved under the print heads on a precisely controlled stage. As the substrate travels relative to the heads, an inkjet printing control system activates individual nozzles within the heads to dispense or eject ink (or other fluid) droplets onto the substrate to form images.

Activating a nozzle of a print head may include sending a fire pulse signal or firing pulse voltage ($V_{fp}$) to the individual nozzle to cause an ejection mechanism to dispense a quantity of ink. In some heads, the pulse voltage is used to trigger, for example, a piezoelectric element that pushes ink out of the nozzle. In other heads the pulse voltage causes a laser to irradiate a membrane that, in response to the laser light, pushes ink out of the nozzle. Other types of transducers adapted to convert a form of activation energy into a mechanical ejection of ink through a nozzle may be employed. Thus, the signal sent to the nozzle may include, for example, a firing pulse voltage, a firing pulse width, a firing pulse current, a firing pulse energy, a firing pulse frequency, and/or a firing pulse waveform shape.

Due to manufacturing variations and/or other factors, nozzles may not dispense drops of equal volume for a given firing pulse parameter $P_{fp}$ (e.g., for a given firing pulse voltage $V_{fp}$, a firing pulse width $W_{fp}$, a firing pulse current $I_{fp}$, a firing pulse energy $E_{fp}$, a firing pulse frequency $F_{fp}$, a firing pulse waveform shape $S_{fp}$, etc.). In some cases, the volume of ink drops may vary non-linearly with $P_{fp}$. In other words, manufacturing variations in print heads may result in non-linear variability in the amount of ink that is jetted for different fire pulses out of the same nozzle and different amounts of ink may be jetted for the same fire pulse out of different nozzles.

The present invention provides a method for determining the amount of ink dispensed by individual nozzles by measuring an amount of light that is transmitted through pixels filled with ink dispensed by the individual nozzles. More specifically, ink may be dispensed with a known $P_{fp}$ into display pixel wells on a substrate and then, using the methods of the present invention, the transmittance of light through the dispensed ink in each pixel well, which corresponds to the thickness of ink within each pixel well, may be measured to determine a volume of ink dispensed by each nozzle (thickness being directly proportional to ink volume). By correlating the known $P_{fp}$ with measured volumes of ink as determined by the transmittance, the present invention further provides a method of determining the relationship between the volume of ink dispensed and $P_{fp}$, and using this relationship to calibrate inkjet print nozzles. This volume information may be used to calibrate each nozzle such that a consistent depth of ink within the pixel wells may be achieved.

The calibration methods provided according to the present invention may take place on a scheduled basis, during routine maintenance procedures, or in response to diagnostic tests performed on one or more display objects during printing operations which indicate that the volume of ink being dispensed by one or more nozzles varies from an expected level or range.

FIG. 1A is a schematic diagram of an example inkjet print nozzle calibration system 100 according to the present invention which uses light transmittance to determine the volume of ink that has been dispensed within a color filter display pixel located on a substrate.

As shown, a substrate 102, which may be a flat panel made of glass, polymer, etc., is positioned on a supporting stage 104. The substrate 102 may include a black matrix material including pixel wells arranged in rows and columns over the surface of the substrate. The pixel wells (shown in greater detail in FIG. 2) are used to store ink dispensed from ink jet print heads (not shown). Each of the pixels may have the same length and width dimensions (the actual length and width of a given pixel may be different) and thus each of the pixels in the matrix on the substrate 102 may be adapted to store a similar volume of ink. Example embodiments of the black matrix and pixel wells that may be used in the context of the present invention are described in previously incorporated U.S. patent application Ser. Nos. 11/521,577 and 11/536,540.

The supporting stage 104 may include a moving platform adapted to transport the substrate in a Y-direction (in a direction into or out of the page in FIG. 1) past one or more print heads positioned over the stage 104 which may dispense ink into the pixel wells of the substrate 102. In color filter printing, typically a single color (e.g., red, green or blue) is dispensed into the pixels of a given column on the substrate 102 while a different color is dispensed into adjacent columns. In such procedures, color mixing is generally avoided. Various aspects of the support stage 104 and print head arrangements that may be used in ink jet printing procedures in the context of the present invention are described in previously incorporated U.S. Provisional Patent Application No. 60/785,594. The supporting stage 104 may include holes, gaps, windows and the like (not shown) that extend through an entire thickness of the stage 104, such that the substrate 102 may be exposed to light emanating from under the supporting stage 104.

A light source 106 may be positioned beneath the supporting stage 104 so as to transmit light via holes, gaps, windows, etc. in the supporting stage 104 and thus illuminate the pixel ink wells on the substrate 102. The light source may comprise, for example, a Phlox 4i-BL Series Backlight provided by Leutron Vision of Burlington, Mass. The 4i-BL Series Backlight light source 106 may include light pipes comprising translucent materials adapted to guide light in a particular direction. The light pipes may be configured such that a substantial proportion of light introduced into the backlight light source 106 (e.g., via LEDs coupled to sides of the backlight) is reemitted uniformly from the top surface 107 of the backlight light source 106. The surface area of the light source 106 may be chosen depending on the size of the substrate 102, and may vary from 20×20 mm to 200×200 mm, for example. Other dimensions may be used. The luminance of the light source 106 may range from approximately 4,000 to 20,000 cd/m$^2$ (candelas per square meter), in inverse proportion to the surface area. The light source 106 may emit white light to provide transmittance through different color inks. In some embodiments, multiple light sources may be used to illuminate the substrate 102.

An optical detection device 108 adapted to measure light transmittance may be positioned so as to capture light transmitted from the light source 106 through the pixel wells of the substrate 102. The optical detection device 108 may comprise a charge coupled device (CCD) camera. A suitable CCD camera that may be used in the context of the present invention, may include, for example, a 7 um pixel size or smaller, a 2000 pixel count or greater, and an intensity accuracy of 0.1%, and a 1×1 lens. Other dimensions and parameters may be used. The optical detection device 108 may be mounted on a support or other feature (not shown) above the supporting stage 104 in an ink jet printing system. As noted, the magnitude of light captured from a particular pixel location on the substrate 102 is proportional to the transmittance of the pixel location, and inversely proportional to the thickness (and volume) of the ink at the pixel location through which the captured light is transmitted. The optical detection device 108 may be movable in the X and Y-axis directions using, for example, one or more motors (not shown).

An image processor 110 which may comprise a computing device, and may be coupled to the optical detection device 108 to acquire image data (which includes the transmittance information.) A host computer 112 (e.g., a UNIX host) may be coupled to the image processor 110 via, e.g., an Ethernet or an RS232 connection. The host computer 112 may comprise a system controller and/or data server for an ink jet printing system. In one or more embodiments, the image processor 110 and the host 112 may be combined. The host computer 112 may be operatively coupled to the light source 106 so as to control the operation of the light source 106 (e.g., activate or de-activate the light source 106, adjust illumination, etc.). In one or more embodiments, the host computer 112 may activate the light source 106 without any delay or start-up time.

Figure 1B:
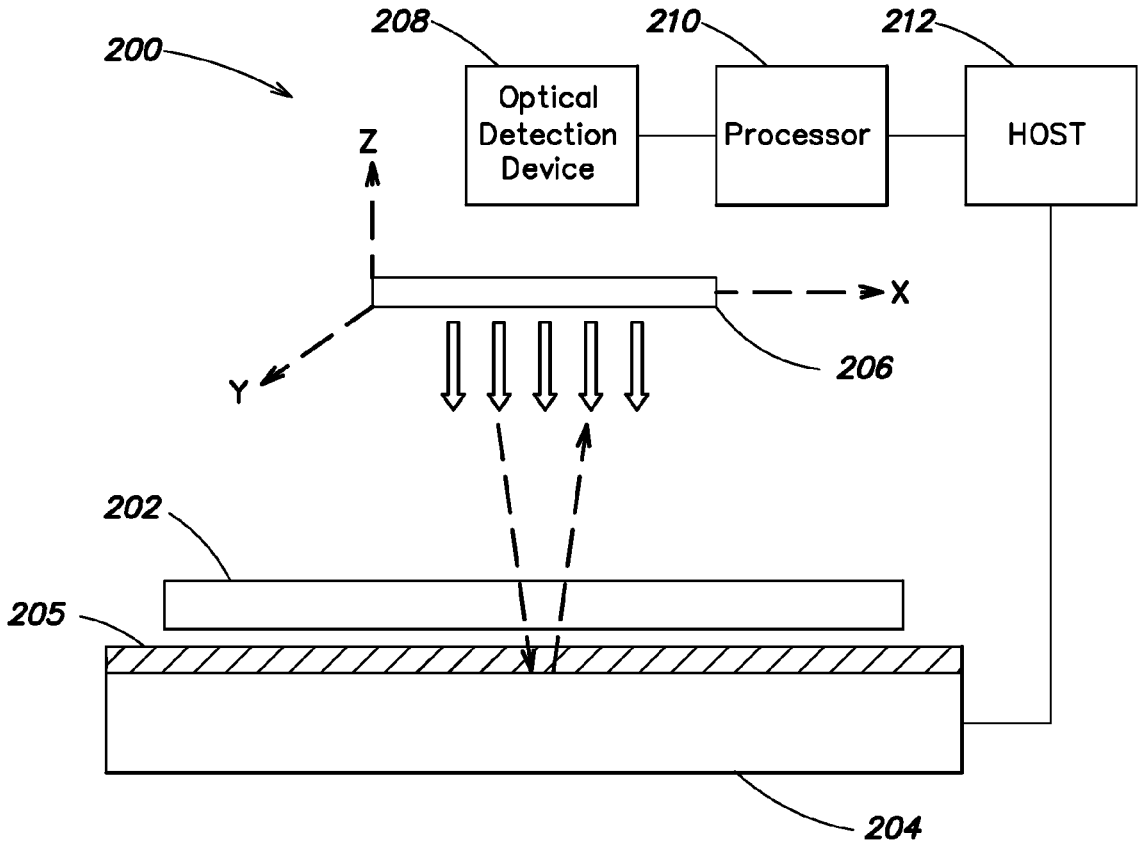
FIG. 1B is a schematic diagram of an inkjet print nozzle calibration system in accordance with alternative embodiments of the present invention.

FIG. 1B depicts a schematic block diagram of an alternate embodiment of an inkjet print nozzle calibration system 200 provided according to the present invention. In the embodiment shown in FIG. 1B, as in the embodiment of FIG. 1A, a substrate 202 including pixel wells is disposed on a supporting stage 204 movable in the Y-axis direction. In this embodiment however, a reflective surface 205 (e.g., a mirror) is positioned between the substrate 202 and the supporting stage 204. In some embodiments, the surface of the stage 204 itself may be reflective. In the example alternative embodiment depicted in FIG. 1B, the light source 206 is disposed above the substrate 202 rather than under the supporting surface. Light emitted from light source 206 is transmitted through the pixel wells on the substrate 202 to the reflective surface 205.

Light incident to the reflective surface 205 may be reflected back through the substrate 202 where it may be captured by optical detection device 208. An image processor 210 is coupled to the optical detection device 208 to process image data, and a host 212 is coupled to the image processor 210. Each of the components of system 200, including the substrate 202, supporting stage 204, light source 206, optical detection device 208, image processor 210 and host 212, may comprise the same or similar components as the corresponding devices discussed above with respect to FIG. 1A.

The inkjet nozzle calibration system 200 shown in FIG. 1B provides the advantages that the light source 206 can be positioned more flexibly in the horizontal (X-Y) plane and/or vertically (Z-axis direction) since light is transmitted directly onto the substrate 202 rather than through holes, gaps or windows in supporting stage 204. Similarly, multiple light sources may be employed and arranged more flexibly in this manner. Moreover, since light emitted from the light source 206 is transmitted through the pixel wells on the substrate 202 twice, once on the incident path through the substrate 202 onto the reflective surface 205, and once on the return path from the reflective surface 205 back through the substrate 202, the amount of transmittance "data" captured by the optical detection device 208 may be effectively doubled.

In either of the embodiments described above, light transmittance from the light source 106, 208 through the pixels on substrate 102, 202 to the optical detection device 108, 208 may be measured and/or computed in a variety of ways. In one or more embodiments, the transmittance of each column of pixel cells may be measured based on an average of the transmittance of one or more representative cells. For example, transmittance in each column may be the average of multiple (M) cells or display pixels, where M may be a preset and/or user defined number.

Figure 2:
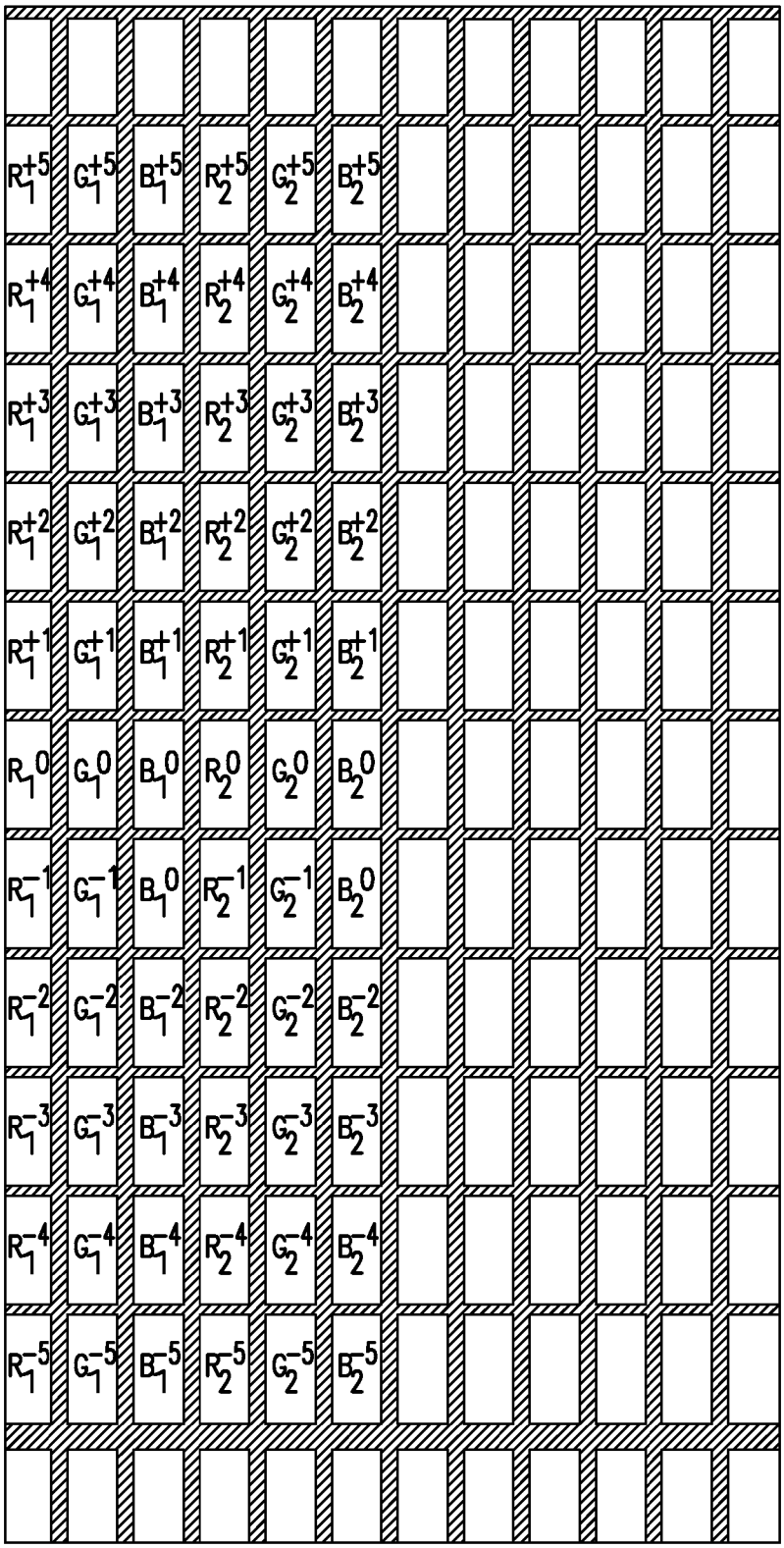
FIG. 2 is a representation of a color filter with printed pixels labeled for reference in accordance with embodiments of the present invention.

Referring to FIG. 2 which is a top view of an example display object on a substrate, a number of pixels are labeled wherein the subscript on a pixel label refers to the pixel column number for a given color and the superscript on the pixel label refers to the pixel row number for a given row. The average transmittance may be calculated using different sets (rows, columns) of transmittance data from pixels. Such data sets may be created for each color, red (R), green (G), and blue (B). An example of data sets of transmittance values for different sized cells may include:

for M=1: $1R_1=R_1^0$; $1R_2=R_2^0$; $1R_3=R_3^0$; . . .

for M=3: $1R_1=(R_1^0+R_1^{+3}+R_1^{-3})$; $1R_2=(R_2^0+R_2^{+3}+R_2^{-3})$; $1R_3=(R_3^0+R_3^{+3}+R_3^{-3})$; . . .

for M=5: $1R_1=(R_1^0+R_1^{+3}+R_1^{-3}+R_1^{+6}+R_1^{-6})$; $1R_2=(R_2^0+R_2^{+3}+R_2^{-3}+R_2^{+6}+R_2^{-6})$; $1R_3=(R_3^0+R_3^{+3}+R_3^{-3}+R_3^{+6}+R_3^{-6})$; . . .

A second data set may include:

for M=1: $2R_1=R_1^{+1}$; $2R_2=R_2^{+1}$; . . .

for M=3: $2R_1=R_1^{+1}+R_1^{+4}+R_1^{-2}$; . . .

for M=5: $2R_1=R_1^{+1}+R_1^{+4}+R_1^{-2}+R_1^{+7}+R_1^{-5}$; . . .

A third data set may include:

for M=1: $3R_1=R_1^{+2}$; . . .

for M=3: $3R_1=R_1^{+2}+R_1^{+5}+R_1^{-1}$; . . .

for M=5: $3R_1=R_1^{+1}+R_1^{+5}+R_1^{-1}+R_1^{+8}+R_1^{-4}$; . . .

Thus, for a given value of M, each color's data may be organized in four data sets:

an original complete data set for the color, e.g., R a data set for 1R which includes 1R1, 1R2, 1R3, . . .

a data set for 2R which includes 2R1, 2R2, 2R3, . . .

a data set for 3R which includes 3R1, 3R2, 3R3, . . .

wherein 1R, 2R, 3R, . . . are calculated as above and ordered based on transmittance in decreasing order.

Figure 3:
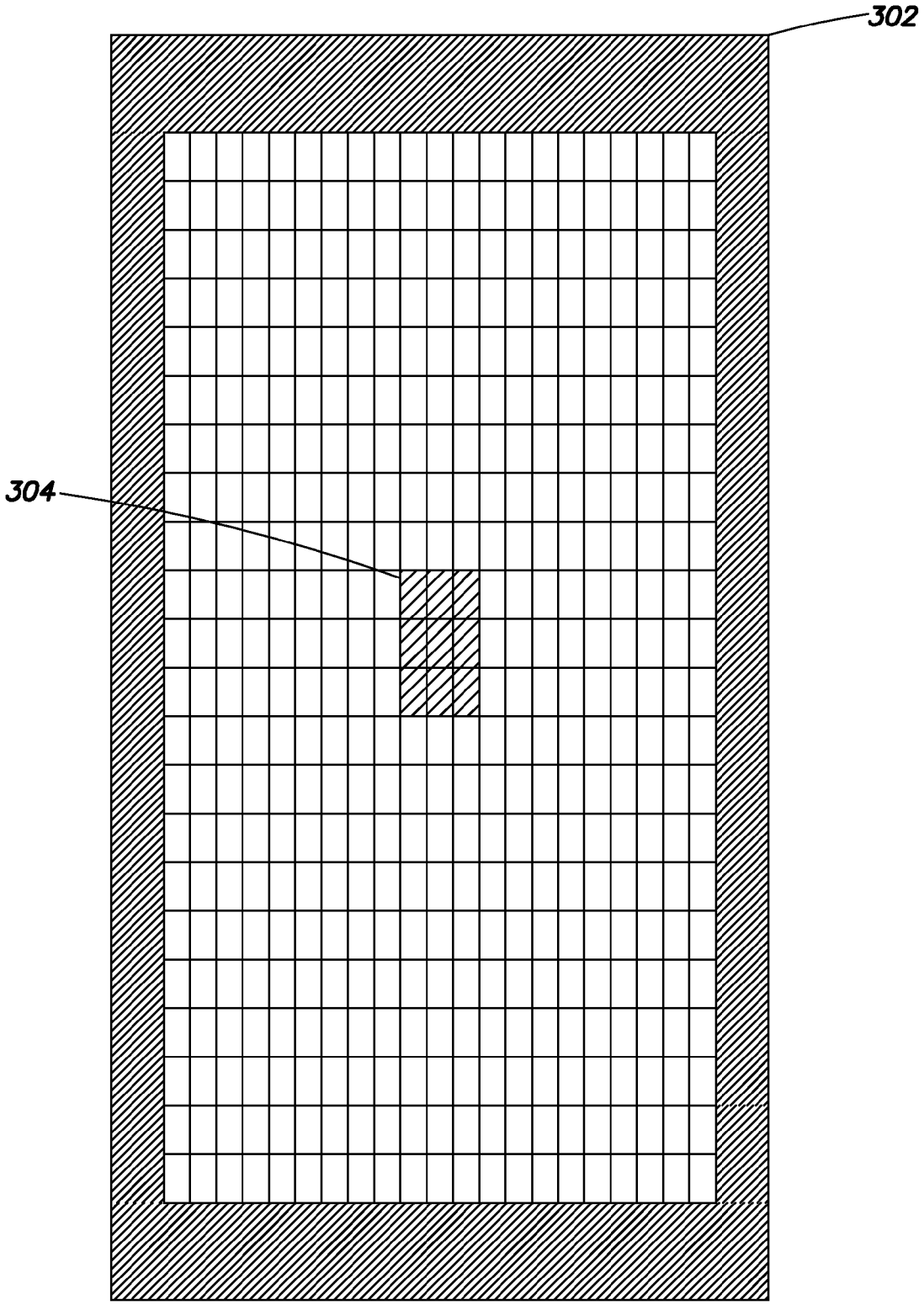
FIG. 3 is a representation of a single display pixel on a substrate as represented by a data file generated using a camera in accordance with embodiments of the present invention.

FIG. 3 is a top view of an example display object on a substrate 302 illustrating an individual display pixel 304. In the particular example, the width of the display pixel 304 may range from about 80 um to about 250 um and have a length from about 200 um to about 600 um. The dark area may be about 20 um to about 40 um in width. Other dimensions may be used. The grid superimposed upon the display pixel 304 is included to indicate the individual "data pixels" that may be used to represent the display pixel 304 in an image file of the display pixel.

Figure 4:
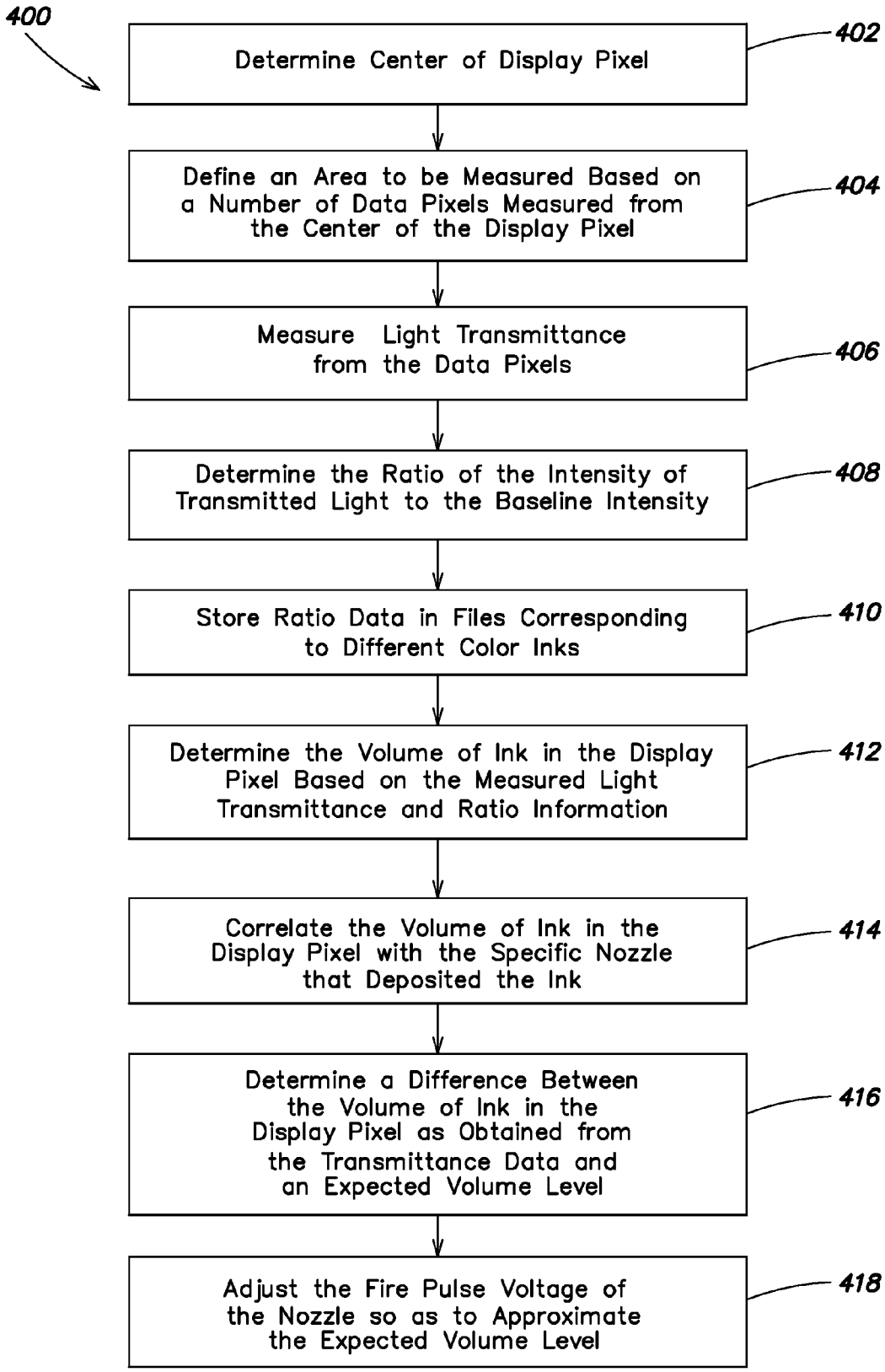
FIG. 4 is a flow chart depicting a method of calibrating an inkjet print nozzle in accordance with an embodiment of the present invention.

FIG. 4 is a flow chart of an example embodiment of a method 400 of calibrating an inkjet print nozzle by determining transmittance of an individual display pixel and adjusting nozzle parameters according to the present invention. Reference numerals in the following discussion are taken from FIG. 1. It is noted however, that the procedures discussed apply equally to the calibration system depicted in FIG. 2.

In step 402, the center of the display pixel 304 is determined. In some embodiments, the center of the display pixel 304 may be determined by finding the center of two dark edges of the display pixel in both x and y directions. Then, in step 404, starting from the center of the display pixel, an area to be measured is defined based on a number (N) of data pixels extending from the center of the display pixel 304. For example, if N is selected to be one, the area to be measured may include one data pixel; if N=2, the area to be measured may include nine data pixels arranged in a rectangle; if N=3, the area to be measured may include twenty-five data pixels and so on. Transmittance data from each of data pixels may be averaged over the display pixel 304. In the particular example depicted in FIG. 3, N=2 and the nine shaded data pixels in the center of the display pixel represent the area to be measured and then averaged to find the display pixel 304 transmittance. Other methods for selecting a representative set of data pixels to be measured and averaged may be used.

In step 406, light transmittance through the data pixels are measured. The measurement may include calculating a ratio of the measured intensity of light that passes through the dispensed ink and the substrate 102 to the measured intensity of light that passes through the substrate 102 alone. Because the amount of light that passes through the substrate 102 alone may vary based on camera position, baseline transmittance data including position-dependant light intensity measurements passing through the substrate alone may be stored initially before the beginning of the exemplary method 400. In some embodiments, the baseline data may include position dependant light intensity measurements through a substrate 102 with or without a black matrix. In alternative embodiments, the baseline may merely store direct measurements of intensity in the absence of the substrate 302. Thus, in such embodiments, measuring the transmittance of a data pixel may include calculating the ratio of the measured intensity of light that passes through both dispensed ink and the substrate 302 to the measured intensity of direct light.

The measurements in step 406 may be automated and performed very rapidly. In some embodiments, the supporting stage 104 of the inkjet printing system may move the substrate 102 and/or the optical detection device 108 to a position for capturing light from the selected display pixel 304. A command to measure may be issued by the host 112. Light intensity data is collected from the data pixels within the display pixel 304. In step 408, the ratio of the intensity of transmitted light over the baseline (or direct) intensity may be computed and averaged for the selected data pixels of the display pixel 304. The ratio data may be stored, in step 410, in a file and/or in different files corresponding to different color inks. By moving the optical detection device 108 along the length (e.g., 7×2000 um) of the substrate 102 and/or by moving the substrate 102, the measurement process may be repeated for further display pixels on the substrate; new data may received may be appended to the existing file(s). After the measurements have been completed, the file(s) including averaged transmittance data may be transferred to the host (e.g., information server or controller of the inkjet printing system). In step 412, the files including the transmittance data may be accessed to determine a volume of ink dispensed within the display pixel 304. In step 414, the volume of ink in the display pixel 304 may be correlated with the specific nozzle that dispensed the ink.

In step 416, a difference between the amount (volume) of ink dispensed in the display pixel 304 as determined from the transmittance data and an expected volume level may be determined. In step 418, adjustments may be made to the fire pulse parameter $P_{fp}$ (e.g., $V_{fp}$, $E_{fp}$, $I_{fp}$, etc.) of the nozzle based on the determined difference so as to cause the amount of ink dispensed by the nozzle into the display pixel 304 to approach the expected volume level. Alternatively, in step 416 it may be determined whether the volume of ink dispensed in the display pixel 304 is outside of an expected range of ink levels. If so, in 418 adjustment(s) may be made to the firing pulse parameter of the nozzle based on how much the determined volume of ink dispensed is outside of the expected range, if not, no adjustment(s) may be made.

In some embodiments, manual measurements of specific display pixels may be made. Images captured by the optical detection device 108 may be displayed on, for example, the image processor 110. A general position may be selected by a user and the transmittance of the selected position may be displayed as a function of position in the X or Y directions. The user may zoom into specific display pixels to get more detailed information.

The foregoing description discloses only particular embodiments of the invention; modifications of the above disclosed methods and apparatus which fall within the scope of the invention will be readily apparent to those of ordinary skill in the art. For example, while the methods described above employ measured light transmittance (intensity) as an index for determining a volume of ink dispensed, it is possible to use measured frequency transmittance to make similar determinations and/or in combination with intensity measurements to determine whether different colored inks are being mixed in one or more pixel wells. In addition, the present invention may also be applied to spacer formation, polarizer coating, and nanoparticle circuit forming.

Accordingly, while the present invention has been disclosed in connection with specific embodiments thereof, it should be understood that other embodiments may fall within the spirit and scope of the invention, as defined by the following claims.

What is claimed is:

1. A method of calibrating an inkjet print nozzle comprising:

dispensing ink onto a substrate with an inkjet print nozzle, the nozzle set at a firing pulse parameter;

measuring a light transmittance characteristic through the dispensed ink while the dispensed ink is on the substrate;

determining a volume of ink dispensed based on the measured transmittance characteristic;

adjusting the firing pulse parameter of the inkjet print nozzle based on a difference between the determined volume of ink dispensed and an expected ink volume level; and prior to dispensing ink on the substrate:

illuminating the substrate in the absence of dispensed ink;

capturing light that has been transmitted through substrate; and determining a baseline light intensity level from the captured light, wherein the measuring of a light transmittance characteristic of the dispensed ink includes measuring an intensity of captured light transmitted through the dispensed ink and determining a ratio between the measured intensity of the captured light and the baseline light intensity level; and wherein the determining of a volume of ink dispensed includes ascertaining a volume of ink that corresponds to the ratio of the measured intensity of captured light and the baseline light intensity level.

2. The method of claim 1 wherein the firing pulse parameter includes at least one of a firing pulse voltage, a firing pulse width, a firing pulse current, a firing pulse energy, a firing pulse frequency, a firing pulse waveform shape.

3. The method of claim 1, further comprising:

illuminating the ink dispensed on the substrate from under the substrate; and capturing light transmitted through the substrate and the dispensed ink above the substrate on a direct path.

4. The method of claim 1, further comprising:

determining a difference between the volume of ink dispensed and an expected volume level.

5. The method of claim 4, wherein adjusting the firing pulse parameter comprises modifying the firing pulse parameter so as to cause the inkjet print nozzle to dispense the expected volume level.

6. The method of claim 5, wherein the modification to the firing pulse parameter varies non-linearly according to the volume of dispensed ink.

7. The method of claim 5, wherein the ink is dispensed into a display pixel well.

8. The method of claim 5, wherein the display pixel well comprises a plurality of areas through which light is transmitted and captured.

9. The method of claim 8, further comprising:

averaging an intensity of captured light from the plurality of areas of the display pixel well.

10. An inkjet print nozzle calibration system comprising:

an inkjet print nozzle adapted to dispense ink onto a substrate in response to a firing pulse, the firing pulse including a firing pulse parameter;

a light source adapted to illuminate ink dispensed on the substrate;

an imaging system adapted to measure a transmittance of light through the dispensed ink while the dispensed ink is on the substrate; and a controller coupled to the imaging system and the inkjet print nozzle and adapted to controllably adjust the firing pulse parameter based on the measured light transmittance, wherein, prior to adjusting the firing pulse parameter based on the measure light transmittance, the controller is further adapted to:

control the light source to illuminate the substrate in the absence of dispensed ink;

use the imaging system to capture light that has been transmitted through substrate; and use the imaging system to determine a baseline light intensity level from the captured light, wherein the imaging system measures transmittance of light through the dispensed ink by measuring an intensity of captured light transmitted through the dispensed ink and determining a ratio between the measured intensity of the captured light and the baseline light intensity level; and wherein the controller is further adapted to determine a volume of ink dispensed by ascertaining a volume of ink that corresponds to the ratio of the measured intensity of captured light and the baseline light intensity level.

11. The inkjet print nozzle calibration system of claim 10 wherein the firing pulse parameter includes at least one of a firing pulse voltage, a firing pulse width, a firing pulse current, a firing pulse energy, a firing pulse frequency, a firing pulse waveform shape.

12. The inkjet print nozzle calibration system of claim 10, wherein the imaging system includes an optical detection device adapted to capture light transmitted through the dispensed ink and an image processor coupled to the optical detection device.

13. The inkjet print nozzle calibration system of claim 12, wherein the optical detection device includes a charge coupled device (CCD) camera.

14. The inkjet print nozzle calibration system of claim 13, wherein the light source is positioned below the substrate and is adapted to transmit light through the substrate into the dispensed ink.

15. The inkjet print nozzle calibration system of claim 10, wherein the controller is adapted to determine a difference between the volume of dispensed ink and an expected volume level.

16. The inkjet print nozzle calibration system of claim 15, wherein the controller is adapted to transmit an adjustment signal to the inkjet print nozzle, the signal adjusting the firing pulse parameter so as to cause the nozzle to dispense a volume of ink approximating the expected volume level.

17. The inkjet print nozzle calibration system of claim 10, wherein the light source emits white light.

18. The inkjet print nozzle calibration system of claim 12, wherein the substrate includes one or more pixel wells for storing dispensed ink.

19. The inkjet print nozzle calibration system of claim 12, wherein the image processor is adapted to calculate an average of measured light transmittance over a plurality of areas of the one or more pixel wells.

* * * * *